US005296128A

United States Patent [19]

Gernon et al.

[11] Patent Number: 5,296,128

[45] Date of Patent: Mar. 22, 1994

[54] GALLIC ACID AS A COMBINATION ANTIOXIDANT, GRAIN REFINER, SELECTIVE PRECIPITANT, AND SELECTIVE COORDINATION LIGAND, IN PLATING FORMULATIONS

[75] Inventors: Michael D. Gernon, North Providence; Hanoch S. Elroi, Wakefield; Brenda A. DeCesare, Warwick; Florence P. Butler, Smithfield, all of R.I.

[73] Assignee: Technic Inc., Cranston, R.I.

[21] Appl. No.: 11,993

[22] Filed: Feb. 1, 1993

[51] Int. Cl.[5] ..... C25D 3/32

[52] U.S. Cl. ..... 205/254; 205/253; 205/302

[58] Field of Search ..... 205/253, 238, 302, 254; 252/622, 1821; 429/46

[56] References Cited

U.S. PATENT DOCUMENTS

| | | | |
|---|---|---|---|
| 3,905,878 | 9/1975 | Dohi et al. | 204/43 S |
| 4,565,609 | 1/1986 | Nobel et al. | 204/44.4 |
| 4,565,610 | 1/1986 | Nobel et al. | 204/44.4 |
| 4,717,460 | 1/1988 | Nobel et al. | 204/444 |
| 4,923,576 | 5/1990 | Kroll et al. | 204/44.4 |
| 4,968,438 | 11/1990 | Soderquist et al. | 210/757 |
| 4,981,564 | 1/1991 | Kroll et al. | 204/44.4 |
| 5,039,576 | 8/1991 | Wilson | 428/626 |
| 5,066,367 | 11/1991 | Nobel et al. | 204/44.4 |
| 5,110,423 | 5/1992 | Little et al. | 205/254 |

FOREIGN PATENT DOCUMENTS 123327 10/1978 Japan .

OTHER PUBLICATIONS

McCarthy, J. A., "Oxidation Characterisitcs of Tin--Plating Electrolytes", Plating, 805-810 (1960).

Meibuhr, E., Carter, P. R., "The Mechanism of the Inhibition of Stannous-Ion Oxidation by Phenolsulfonic Acid", Electrochemical Technical, 2, 267-273 (1964).

Stirrup, B. N., Hampson, N. A., "Electrochemical Reactions of Tin in Aqueous Electrolytic Solutions", Surface Tech., 5, 429-462 (1977).

*Primary Examiner*—Kathryn Gorgos

*Attorney, Agent, or Firm*—Ernest V. Linek

[57] ABSTRACT

This invention relates to additives for methanesulfonic acid based tin and tin alloy plating formulations. Specifically, the invention involves the use of gallic acid in the multiple roles of antioxidant, grain refiner, selective precipitant, and selective chelator in methanesulfonic acid based tin or tin alloy plating formulations.

21 Claims, No Drawings

GALLIC ACID AS A COMBINATION ANTIOXIDANT, GRAIN REFINER, SELECTIVE PRECIPITANT, AND SELECTIVE COORDINATION LIGAND, IN PLATING FORMULATIONS

FIELD OF THE INVENTION

This invention relates to additives for methanesulfonic acid based tin and tin alloy plating formulations. Specifically, the invention involves the beneficial use of gallic acid in the multiple roles of antioxidant, grain refiner, selective precipitant, and selective chelator in methanesulfonic acid based tin or tin alloy plating formulations.

BACKGROUND OF THE INVENTION

Electrodeposits of tin, tin/lead, tin/antimony, tin/bismuth, and the like, are utilized in the finishing of electronic components. Most plating formulations employing tin salts rely on tin in the stannous (+2) oxidation state. The normal operation of tin alloy electroplating solutions can result in significant oxidation of stannous (+2) to stannic tin (+4). Stannic tin is not readily electropdeposited from methanesulfonic acid based plating baths, and the build-up of Sn(+4 or IV) in a plating bath is undesirable.

The tin oxidation process is not fully understood, but the involvement of active oxygen is suspected. Factors which lead to increased solution oxygen concentration are known to contribute to tin oxidation, though oxidation rate acceleration beyond that attained in an oxygen saturated solution is not normally observed.

The formation of stannic tin derived sludge is a particularly undesirable aspect of tin oxidation. In practice, tin and tin alloy electroplating baths are formulated with an antioxidant which prevents the oxidation of stannous to stannic tin. Hydroquinone, catechol, phenidone, morin hydrate, and vanadium (V) oxide are representative examples of known antioxidants. Many antioxidants, such as the dihydroxybenzenes, are believed to function by reacting with the active oxygen compound(s) responsible for tin oxidation. In the case of vanadium (V), a mechanism involving catalysis of the reaction between stannic and metallic tin has been proposed.

It is well known that different plating electrolytes, under a given set of otherwise identical conditions, strongly influence the extent of tin oxidation. Methanesuffonic acid ($CH_3SO_3H$) and fluoboric acid ($HBF_4$) are two well known examples of conductive electrolytes for tin and tin alloy plating. Methanesulfonic acid based tin alloy plating solutions are relatively resistant to tin oxidation when compared to fluoboric acid based tin alloy plating solutions. The tendency for tin oxidation in fluoboric acid based systems is so great that an oxygen sparged fluoboric acid based tin electrolyte without an antioxidant will be completely converted to stannic tin within an hour. A methanesulfonic acid based tin electrolyte exposed to oxygen sparging without an antioxidant will typically take several days before 50% stannic tin is present. This marked difference between methanesulfonic acid based and fluoboric acid based electrolytes has been well known within the electroplating field for many years.

While antioxidant free methanesulfonic acid based electrolytes are significantly better than antioxidant free fluoboric acid based electrolytes for tin and tin alloy plating, it is still advantageous to incorporate an antioxidant into a methanesulfonic acid based system. It is further desirable that the antioxidant added to a tin alloy electroplating formulation have additional positive influences on the electrodeposition process. These can include grain refining, selective metal coordination, and selective precipitation of bothersome impurities.

Grain refining involves all chemical processes which influence the morphology and average size of the microscopic electrodeposit surface. The importance of grain morphology and size is well known in the art.

Selective metal coordination is used in alloy plating formulations where the different reduction potentials of the metals being deposited lead to selective enrichment of one metal over the other in the electrodeposit. The proper degree of selective coordination will result in a plating formulation which deposits a consistent alloy at different current densities. A consistent alloy is particularly important in the electronics industry, where deposit solderability and performance are critically affected by alloy.

The value of materials which selectively precipitate undesirable impurities is obvious. One problem associated with tin oxidation is the removal of the finely dispersed stannic tin which forms. Stannic tin at low concentrations is seen as a cloudy impurity which is difficult to filter free from plating solutions. Normally, flocculation prior to stannic tin filtration is necessary. Chemical agents which selectively precipitate stannic tin in a form which can be removed by commonly used filter media eliminate the need for time consuming flocculation treatments. Such selective stannic tin removal also reduces the potential deleterious effects of soluble stannic tin on electrodeposit quality.

SUMMARY OF THE INVENTION

One object of the present invention is to provide an improved tin and tin alloy electroplating process. The improvement is attained by the addition of an effective amount of gallic acid to an otherwise traditional tin or tin alloy plating formulation. The effective amount of gallic acid added to such plating bath formulations has been found to range from about 0.1 to about 30 g/l, preferably from about 0.5 to about 15 g/l, and most preferably from about 1 to about 5 g/l. It has been found that when added thereto, the gallic acid functions as an oxidation inhibitor, selective stannic tin precipitant, selective metal ion complex or and grain refiner.

It is another object of this invention that the grain refinement, stannic tin precipitation, and selective metal ion complexation exhibited by gallic acid be beneficial for the commercial electrodeposition of tin or tin alloys.

Thus, this invention relates to improvements in tin and tin alloy plating formulations, wherein gallic acid is added thereto as an antioxidant, selective chelator, and selective SN(IV) precipitant. Preferably, the gallic acid is added to methanesulfonic acid based plating formulations designed for the deposition of tin, tin/lead, tin/antimony, and tin/bismuth alloys. Such plating formulations will contain in addition to free methanesulfonic acid, soluble salts of tin. Alloys can be deposited by the addition of soluble lead, and/or antimony, and/or bismuth salts. In addition to the metal salts, complexing acids may be present to increase the solubility of one or both of the metal ions. Surfactants and/or organic additives may also be present as grain refiners. Preferred wetting agents for the formulations disclosed in the present invention include nonionic, cationic, and anionic surfactants.

The novel utility of gallic acid in such formulations results from its multiple roles as:

1. Selective precipitant of stannic tin species
2. Selective ligand for the coordination of tin in a Sn/Pb bath
3. Selective ligand for the coordination of tin in a Sn/Bi bath
4. Antioxidant
5. Grain refiner Individually, any of the previously mentioned effects would be considered beneficial. Together, the attainment of all these effects with a single additive is clearly an unexpected benefit to the plating arts.

DETAILED DESCRIPTION OF THE PREFERRED EMBODIMENTS

A preferred bath in accordance with the invention includes typical components for depositing a tin, and/or tin/lead, and/or tin/antimony, and/or tin/bismuth alloy. For instance, such a bath will include a water soluble tin salt, with the possible inclusion of water soluble lead, and/or antimony, and/or bismuth salts. Such salts include methanesulfonates, fluoborates, and/or tartrates. Common tin alloy electroplating baths may include tin methanesulfonate, lead methanesulfonate, bismuth methanesulfonate, antimony potassium tartrate, and methanesuffonic acid. The concentration of tin in the bath, as stannous methanesulfonate for instance, preferably ranges from 5 to about 200 grams per liter. The lead (as plumbous methanesulfonate for instance), and/or bismuth (as bismuthous methanesulfonate for instance), and/or antimony (as potassium stibinous tartrate for instance) content will be between 0.05% and 99% that of the total metal. The methanesulfonic acid concentration preferably ranges from about 5 to 300 grams per liter.

Alloy deposits plated from the formulations of this invention will be between 1% and 100% tin with the balance being lead, and/or bismuth, and/or antimony.

In accordance with the present invention, surfactants and other plating bath additives in addition to gallic acid may be any of those known in the art. See, for example U.S. Pat. Nos. 4,981,564, 4,923,576 and 5,110,423, the disclosures of which are hereby incorporated herein by reference. The preferred additives include chloro-terminated polyoxyalkylene nonionic surfactants. Such surfactants (trade name Avanel N) have the desirable attribute of very low foam production/stabilization. Such low foaming properties are particularly important in automated high speed plating and other applications where solution agitation is vigorous.

The baths described in the U.S. Pat. Nos. 4,981,564, 4,923,576 and 5,110,423 are particularly well suited for improvement by the use of gallic acid as disclosed herein. While not wishing to be bound by theory, from the work conducted to date with gallic acid, it is believed that in all tin and tin alloy plating baths, gallic acid will provide beneficial effects as a combination antioxidant, grain refiner, selective coordination ligand, and selective precipitant of stannic tin. The multifold beneficial effects of gallic acid represent a novel discovery in plating science.

EXAMPLES

The present invention will be further illustrated with reference to the following examples which aid in the understanding of the present invention, but which are not to be construed as limitations thereof. All percentages reported herein, unless otherwise specified, are percent by weight. All temperatures are expressed in degrees Celsius.

The following abbreviated terms used in the examples are defined herein as follows:

EO/PO Copolymer - a nonionic surfactant having the general formula:

$$Y-\overset{R_2}{\overset{|}{C}}HCH_2O\left[\overset{R_2}{\overset{|}{C}}H-CH_2O\right]_n\left[\overset{R_1}{\overset{|}{C}}H_2CHO\right]_m\left[\overset{R_2}{\overset{|}{C}}H_2CHO\right]_n\overset{R_2}{\overset{|}{C}}H_2CH-X$$

where $R_1$ and $R_2$ may be hydrogen or methyl and m and n may be integers between 1 and 100; X and Y may be a halogen, alkyl, aryl, aralkyl, alkoxy, aralkoxy or hydroxyl group.

Blocked EO/PO Copolymer - a nonionic surfactant having the general formula:

$$RO-\left[\overset{R_1}{\overset{|}{C}}H_2CHO\right]_m\left[\overset{R_2}{\overset{|}{C}}H_2CHO\right]_n-\overset{R_2}{\overset{|}{C}}H_2CH-X$$

where R represents a $C_1$ to $C_{18}$ alkyl group, a $C_1$ to $C_{12}$ alkyl benzene, a beta-naphthalene nucleus or a hydrogen atom; $R_1$ and $R_2$ may be hydrogen or methyl and m and n may be integers between 1 and 100; and X may be a halogen, alkyl, aryl, aralkyl, alkoxy, aralkoxy or hydroxyl group.

Example 1

Four plating formulations were prepared as follows:

| Component | Bath A | Bath B | Bath C | Bath D |
|---|---|---|---|---|
| Stannous Methanesulfonate | none | 50 g/l | none | 50 g/l (as tin) |
| Stannous Fluoborate (as tin) | 50 g/l | none | 50 g/l | none |
| Free Acid | 23% v/v ($HBF_4$) | 18% v/v (MSA) | 23% v/v ($HBF_4$) | 18% v/v (MSA |
| EO/PO Copolymer | 2 g/l | 2 g/l | 2 g/l | 2 g/l |
| Blocked EO/PO Copolymer | 2 g/l | 2 g/l | 2 g/l | 2 g/l |
| Boric Acid | 26 g/l | none | 26 g/l | none |
| Hydroquinone | none | none | 2 g/l | 2 g/l |

The plating solutions were all stirred at identical rates and sparged with 200 cc/minute of oxygen gas. Acid were used as the normal commercially available solution strengths (MSA—70%, $HBF_4$—48%). Divalent tin was analyzed periodically by titration. The results were as follows:

| Hours of Oxygen Sparging | % Sn (II) Remaining | | | |
|---|---|---|---|---|
| | A | B | C | D |
| 0.0 | 100 | 100 | 100 | 100 |
| 2.0 | 0.0 | 97 | 99 | 100 |
| 7.5 | 0.0 | 90 | 96 | 98 |
| 15.0 | 0.0 | 73 | 96 | 97 |
| 40.0 | 0.0 | 45 | 96 | 96 |

In formulations without an antioxidant, it is clearly shown that the rate of tin oxidation is much higher in the fluoborate electrolyte than it is in a comparable methanesulfonate electrolyte. The addition of hydroquinone decreases the rate of oxidation in both electrolytes.

Example 2

| Three plating solutions were prepared as follows: | | | |
|---|---|---|---|
| Component | Bath A | Bath B | Bath C |
| Stannous Methanesulfonate (as tin) | 50 g/l | 50 g/l | 50 g/l |
| Free MSA | 18% v/v | 18% v/v | 18% v/v |
| EO/PO Copolymer | 1 g/l | 1 g/l | 1 g/l |
| Blocked EO/PO Copolymer | 2 g/l | 2 g/l | 2 g/l |
| Gallic Acid | none | 0.5 g/l | 2 g/l |

The plating solutions wee all stirred at identical rates and sparged with 200 cc/minute of oxygen gas. Divalent tin was analyzed periodically by titration. The results are as follows:

| | % Sn (II) Remaining | | |
|---|---|---|---|
| Hours of Oxygen Sparging | A | B | C |
| 0.0 | 100 | 100 | 100 |
| 2.0 | 97 | 99 | 99 |
| 7.5 | 90 | 96 | 96 |
| 15.0 | 73 | 96 | 96 |
| 40.0 | 45 | 95 | 94 |

The ability of an effective amount of gallic acid to function as an antioxidant is clearly demonstrated by these data.

Example 3

| Three plating solutions were prepared as follows: | | | |
|---|---|---|---|
| Component | Bath A | Bath B | Bath C |
| Stannous Methanesulfonate (as tin) | 74 g/l | 74 g/l | 74 g/l |
| Plumbous Methanesulfonate (as lead) | 16 g/l | 16 g/l | 16 g/l |
| Free MSA | 10% v/v | 10% v/v | 10% v/v |
| EO/PO Copolymer | 1 g/l | 1 g/l | 1 g/l |
| Blocked EO/PO Copolymer | 4 g/l | 4 g/l | 4 g/l |
| 1,10-phenanthroline | 2 ppm | 2 ppm | 2 ppm |
| 2,2'-bipyridine | 4 ppm | 4 ppm | 4 ppm |
| Gallic Acid | none | none | 2 g/l |
| Hydroquinone | none | 2 g/l | none |

Each solution was tested by electrodepositing Sn/Pb alloy on a copper plated brass Hull cell panel at 6 Amps for 2 minutes. The alloy was analyzed by X-ray fluorescence spectroscopy. The results were as follows:

| | % Sn (II) in deposited Sn/Pb alloy | | |
|---|---|---|---|
| Current Density (ASF) | A | B | C |
| 90 | 75 | 75 | 70 |
| 120 | 80 | 75 | 70 |
| 150 | 80 | 80 | 70 |
| 180 | 80 | 80 | 70 |
| 240 | 80 | 80 | 70 |

The selective coordination of stannous tin by an effective amount of gallic acid resulted in a more constant tin content in the electrodeposited alloy. Such selective complexation of tin results in a more constant alloy tin content at different plating current densities.

Example 4

| Three plating baths were prepared as follows: | | | |
|---|---|---|---|
| Component | Bath A | Bath B | Bath C |
| Stannous Methanesulfonate (as tin) | 74 g/l | 74 g/l | 74 g/l |
| Bismuth (III) Methanesulfonate (as bismuth) | 4 g/l | 4 g/l | 4 g/l |
| Free MSA | 10% v/v | 10% v/v | 10% v/v |
| EO/PO Copolymer | 1 g/l | 1 g/l | 1 g/l |
| Blocked EO/PO Copolymer | 3 g/l | 3 g/l | 3 g/l |
| 2,9-Dimethyl-1,10-phenanthroline | 3 ppm | 3 ppm | 3 ppm |
| Gallic Acid | none | none | 3 g/l |
| Hydroquinone | none | 2 g/l | none |

Each solution was tested by electrodepositing Sn/Bi alloy on a copper plated brass Hull cell panel at 6 Amps for 2 minutes. The alloy was analyzed by X-ray fluorescence spectroscopy. The results, converted to indicate the percent of bismuth incorporation relative to solution content (100% is optimal), were as follows:

| | % Bi in deposit relative to Bi in solution | | |
|---|---|---|---|
| Current Density (ASF) | A | B | C |
| 90 | 20 | 20 | 40 |
| 120 | 20 | 25 | 40 |
| 150 | 20 | 20 | 60 |
| 180 | 20 | 20 | 60 |
| 240 | 40 | 40 | 80 |

The selective coordination of tin by an effective amount of gallic acid resulted in a plating formulation which deposited a Sn/Bi alloy very close in weight percent to the metal content of the plating solution.

Example 5

| Three plating solutions were prepared as follows: | | | |
|---|---|---|---|
| Component | Bath A | Bath B | Bath C |
| Stannous Methanesulfonate (as tin) | 74 g/l | 74 g/l | 74 g/l |
| Plumbous Methanesulfonate (as lead) | 16 g/l | 16 g/l | 16 g/l |
| Free MSA | 10% v/v | 10% v/v | 10% v/v |
| EO/PO Copolymer | 1 g/l | 1 g/l | 1 g/l |
| Blocked EO/PO Copolymer | 5 g/l | 5 g/l | 5 g/l |
| 1,10-phenanthroline | 2 ppm | 2 ppm | 2 ppm |
| Gallic Acid | none | none | 2 g/l |
| Hydroquinone | none | 2 g/l | none |

Each solution was tested by electrodepositing Sn/Pb alloy on a copper plated brass Hull cell panel at 6 Amps for 2 minutes. The deposit appearance and grain were analyzed by visual inspection. The results were as follows (B=bright, M=matte, S=smooth, G=gas streaked):

| Current Density (ASF) | % Sn (II) Remaining A | B | C |
|---|---|---|---|
| 90 | M/S | M/S | M/S |
| 120 | M/S | M/S | M/S |
| 150 | M/S | M/G | M/S |
| 180 | B/S | B/G | M/S |
| 240 | B/S | B/G | M/S |

For high-speed electronics applications, a matte (M) and smooth (S) deposit is optimal. The incorporation of an effective amount of gallic acid is seen to produce a better deposit over a wider range of current densities than formulas with traditional antioxidants such as hydroquinone or formulations with no antioxidant at all.

Example 6

Three plating solutions were prepared as follows:

| Component | Bath A | Bath B | Bath C |
|---|---|---|---|
| Stannous Methanesulfonate (as tin) | 52 g/l | 52 g/l | 52 g/l |
| Free MSA | 16% v/v | 16% v/v | 16% v/v |
| EO/PO Copolymer | 1 g/l | 1 g/l | 1 g/l |
| Blocked EO/PO Copolymer | 3 g/l | 3 g/l | 3 g/l |
| Gallic Acid | none | 2 g/l | none |
| Hydroquinone | none | none | 2 g/l |

The plating solutions were all stirred at identical rates and sparged with 200 cc/minute of oxygen gas for 134 hours. The stannous and stannic tin contents of baths A through C are shown below.

| | A | B | C |
|---|---|---|---|
| Total tin | 51 g/l | 51 g/l | 51 g/l |
| Stannous tin | 18 g/l | 48 g/l | 48 g/l |
| % Stannous tin remaining | 35% | 94% | 94% |
| Stannic tin | 33 g/l* | 3 g/l* | 3 g/l |
| Solution Appearance | brown, cloudy | colorless, precipitate | yellowish, no precipitate |

*Precipitate was fully suspended in solution prior to drawing a sample for analysis.

These data demonstrate than an effective amount of gallic acid is at least as effective as hydroquinonone in the prevention of stannous tin oxidation. More importantly, however, the gallic acid stabilized tin plating electrolyte displayed a qualitative difference in appearance after exposure to a large amount of oxygen. The hydroquinone stabilized solution was minimal stannous tin oxidation, but the small amount of tin which was oxidized remains in solution. The use of an effective amount of gallic acid prevents oxidation just as well as hydroquinone, but in contrast to hydroquinone, the small amount of tin which was oxidized was partially precipitated from solution. This is a beneficial result not provided by hydroquinone.

Example 7

A 100 ml portion of solution A (Example 6, after oxidation) was treated with 2.0 grams of gallic acid (i.e., a 20 g/l treatment) and stirred for 30 minutes. The solution was centrifuged and the solid collected by gravity filtration. The clear and colorless filtrate was analyzed for stannous and stannic tin content. The collected solid was rapidly washed several times with 15% MSA (aq), Dl water, ethanol, and ether. The washed solid was rapidly freed of volatiles and then immediately analyzed for stannous and stannic tin content.

| | Filtrate Analysis: Before Gallic Acid Treatment | After Gallic Acid Treatment |
|---|---|---|
| Stannous Tin | 18.2 g/l | 10.4 g/l |
| Stannic Tin | 33.0 g/l | 1.9 g/l |

Gallic acid treatment (at an effective amount) removes 94% of the stannic tin and only 42% of the stannous tin from a highly oxidized tin methanesulfonate electrolyte. Clearly, the use of an effective amount of gallic acid as set forth herein selectively precipitates stannic tin.

| Precipitate Analysis | |
|---|---|
| % tin | 57% |
| % Stannous tin (relative to total tin) | 20% |
| % Stannic Tin (relative to total tin) | 80% |
| % Gallic Acid | 43% |
| Mole Ratio [Gallic Acid]/[Tin] | 1/2 |

A similar treatment of 100 ml of bath A (Example 6, after oxidation) with 2.0 grams of hydroquinone (i.e., a 20 g/l addition level) produced no precipitate even after stirring for 48 hours. In addition, analysis of bath A (Example 6, after oxidation) before and after hydroquinone addition/filtration showed identical stannic tin and stannous tin levels. Clearly, hydroquinone showed no tendency to selectively precipitate stannic tin.

Example 8

Two 6 gallon plating solutions were prepared as follows:

| Component | Bath A | Bath B |
|---|---|---|
| Stannous Methanesulfonate (as tin) | 74 g/l | 74 g/l |
| Plumbous Methanesulfonate (as lead) | 7 g/l | 7 g/l |
| Free MSA | 16% v/v | 16% v/v |
| EO/PO Copolymer | 1 g/l | 1 g/l |
| Blocked EO/PO Copolymer | 3 g/l | 3 g/l |
| Gallic Acid | none | 2 g/l |
| 2,9-dimethyl-1,10-phenanthroline | 4 ppm | 4 ppm |
| Hydroquinone | 2 g/l | none |

Each plating solution was filtered at a rate of 5 gallon per minute. Lead frames were plated daily from each solution for a total of 5 amp-hours of work. After three months, bath A (hydroquinone) was yellowish and essentially free of suspended or settled solids while bath B was colorless with some precipitate on the walls of the plating tank. The filter cartridges from each bath were removed. The cartridge from bath B (gallic acid) had 3.0 grams of collectable solid deposit. The solid collected from the gallic acid stabilized plating bath consisted of a mixture of lead, tin, and gallic acid gallate (ostensibly lead gallate and tin gallate). The tin in the collected precipitate was 80% stannic and 20% stannous. The plating solutions were analyzed on a regular basis for dissolved stannous and stannic tin. Bath A (hydroquinone) initially had very low stannic tin content, but with time the dissolved stannic tin level steadily grew. After three months the stannic tin content of bath A reached 5% of the total tin level. Bath B (gallic acid) also initially had a very low stannic tin content, but contrary to Bath A the dissolved stannic tin content of bath B remained negligible throughout the 3 month plating trial. In Bath B, the stannic tin which did form was mostly precipitated from solution. In Bath A, the stannic tin which formed remained dissolved in solution.

The undesirability of solubilized stannic tin in solder plating baths is well known in the art. An effective amount of gallic acid, useful primarily as an antioxidant, clearly offers the additional advantage of precipitating stannic tin from MSA based solder plating baths.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A method of improving acidic tin and tin alloy electroplating baths, which comprises adding gallic acid thereto, whereby the resulting improvement is selected from one or more of the following bath properties, oxidation stability, grain refinement, selective precipitation of Sn(IV) and chelation or complex coordination of other metals in the bath.

2. The method of claim 1, wherein the effective amount of gallic acid ranges from about 0.1 to about 30 g/l of the plating bath formulation.

3. The method of claim 1, wherein the effective amount of gallic acid ranges from about 0.5 to about 15 g/l of the plating bath formulation.

4. The method of claim 1, wherein the effective amount of gallic acid ranges from about 1 to about 5 g/l of the plating bath formulation.

5. The method of claim 1, wherein the improvement comprises better grain refinement than that obtained in the same bath but without added gallic acid.

6. The method of claim 1, wherein the improvement comprises better stannic tin precipitation than that obtained in the same bath but without added gallic acid.

7. The method of claim 1, wherein the improvement comprises the selective metal ion complexation of stannous and stannic tin species than that obtained in the same bath but without added gallic acid.

8. The method of claim 1, wherein the electroplating bath formulation comprises methanesulfonic acid.

9. The method of claim 1, wherein the electroplating bath formulation comprises fluoboric acid.

10. The method of claim 1, wherein the electroplating bath formulation comprises a soluble tin compound at a concentration of from about 5 to about 200 g/l.

11. The method of claim 10, wherein the electroplating bath formulation further comprises a soluble alloying compound selected from the group consisting of lead, bismuth, antimony, and mixtures thereof, at a concentration of from about 0.05 to 99% of the concentration of the total metals.

12. In an acidic electroplating bath composition comprising a conductive electrolyte and a soluble tin plating salt, wherein the improvement comprises; gallic acid added thereto to serve as an antioxidant, selective chelator, and selective Sn(IV) precipitant.

13. The improved electroplating bath composition of claim 12, wherein the conductive electrolyte is methanesulfonic acid.

14. The improved electroplating bath composition of claim 12, wherein the conductive electrolyte is fluoboric acid.

15. The improved electroplating bath composition of claim 12, which further comprises a soluble alloying salt selected from the group consisting of lead salts, bismuth salts, antimony salts, and mixtures thereof, at a concentration of from about 0.05 to 99% of the concentration of the total metals.

16. The improved electroplating bath composition of claim 15, wherein the soluble alloying salt comprises a lead salt.

17. The improved electroplating bath composition of claim 15, wherein the soluble alloying salt comprises an antimony salt.

18. The improved electroplating bath composition of claim 15, wherein the soluble alloying salt comprises a bismuth salt.

19. The improved electroplating bath composition of claim 12, wherein the plating formulation further comprises one or more complexing acids to increase the solubility of the metal ions.

20. The improved electroplating bath composition of claim 12, wherein the plating formulation further comprises one or more surfactants or wetting agents selected from the group consisting of nonionic, cationic, and anionic surfactants.

21. The improved electroplating bath composition of claim 12, wherein the plating formulation further comprises one or more organic additives as grain refiners.

* * * * *